US006141896A

United States Patent [19]

Oberst

[11] Patent Number: 6,141,896

[45] Date of Patent: Nov. 7, 2000

[54] LOCKABLE FIREARM SAFETY

[75] Inventor: E. Ernest Oberst, Cheshire, Conn.

[73] Assignee: The Marlin Firearms Company, North Haven, Conn.

[21] Appl. No.: 09/067,487

[22] Filed: Apr. 27, 1998

[51] Int. Cl.[7] ..... F41A 17/22; F41A 17/26; F41A 17/02

[52] U.S. Cl. ..... 42/70.06; 42/70.07; 42/72.08; 42/70.11

[58] Field of Search ..... 42/70.06, 70.08, 42/70.11, 70.07

[56] References Cited

U.S. PATENT DOCUMENTS

| | | | |
|---|---|---|---|
| 2,000,858 | 5/1935 | Maxwell | 42/70.06 |
| 2,225,583 | 12/1940 | Blizard | 42/70.06 |
| 3,462,869 | 8/1969 | Wallace | 42/70.11 |
| 3,553,877 | 1/1971 | Welch et al. . | |
| 3,673,725 | 7/1972 | Cravener . | |
| 3,735,519 | 5/1973 | Fox . | |
| 3,861,069 | 1/1975 | Heurlén . | |
| 3,882,622 | 5/1975 | Perlotto | 42/70.11 |
| 4,002,101 | 1/1977 | Tellie | 89/142 |
| 4,136,475 | 1/1979 | Centille | 42/70.11 |
| 4,457,091 | 7/1984 | Wallerstein | 42/70.11 |
| 4,467,545 | 8/1984 | Shaw, Jr. . | |
| 4,763,431 | 8/1988 | Allan et al. | 42/70.11 |
| 4,926,575 | 5/1990 | Pastor | 42/70.06 |
| 4,987,693 | 1/1991 | Brooks | 42/70.11 |
| 5,016,378 | 5/1991 | Sain | 42/70.06 |
| 5,025,582 | 6/1991 | Mote, Sr. | 42/70.06 |
| 5,062,232 | 11/1991 | Eppler | 42/70.11 |
| 5,090,148 | 2/1992 | Brooks | 42/70.11 |
| 5,140,766 | 8/1992 | Brooks | 42/70.11 |
| 5,229,532 | 7/1993 | Brooks | 42/70.11 |
| 5,303,495 | 4/1994 | Harthcock | 42/70.11 |
| 5,335,521 | 8/1994 | Brooks | 42/70.11 |
| 5,408,777 | 4/1995 | Brooks | 42/70.11 |
| 5,457,907 | 10/1995 | Brooks | 42/70.11 |
| 5,502,915 | 4/1996 | Mendelsohn et al. | 42/70.11 |
| 5,546,690 | 8/1996 | Ciluffo | 42/70.11 |
| 5,560,134 | 10/1996 | Van Niekerk et al. | 42/70.06 |
| 5,560,135 | 10/1996 | Ciluffo | 42/70.07 |
| 5,603,179 | 2/1997 | Adams | 42/70.08 |

FOREIGN PATENT DOCUMENTS

| | | | |
|---|---|---|---|
| 31 16707 A1 | 11/1982 | Germany . | |
| 4300532 | 7/1994 | Germany | 42/70.11 |
| 586885 | 4/1977 | Switzerland | 42/70.06 |
| 616326 | 1/1949 | United Kingdom | 42/70.06 |
| 8203120 | 9/1982 | WIPO | 42/70.11 |

*Primary Examiner*—Stephen M. Johnson
*Attorney, Agent, or Firm*—Alix, Yale & Ristas, LLP

[57] ABSTRACT

A lockable firearm safety is incorporated into the bolt mechanism of a safety bolt to selectively block the forward motion of the hammer by either of two means: (a) preventing the trigger from moving rearward which movement would release the hammer permitting it to move forward and strike the firing pin; (b) by directly blocking the hammer from moving forward to strike the firing pin. When the safety bolt is placed in the safety position, the bolt may be locked in the safety position by means of a key. The firearm cannot be discharged until the safety bolt is unlocked and is moved to the fire position.

12 Claims, 7 Drawing Sheets

LOCKABLE FIREARM SAFETY

BACKGROUND OF THE INVENTION

This invention relates generally to safety devices employed in firearms to prevent accidental or unauthorized discharge of the firearm. More particularly, this invention relates to safety devices which are lockable to prevent discharge of the firearm.

Safeties for firearms are commonplace, and numerous safety configurations have been advanced. One general type of safety mechanism involves the use of a manually displaceable cross bolt which is oriented generally transversely to the firearm barrel. The safety is operated by manually displacing the bolt between two axial positions which are retained by a spring biased detent or other means.

One such type of safety involves a hammer block which is axially displaceable between a fire and a safety position. The cross bolt is configured to selectively interfere with the hammer and/or a component in the trigger/hammer assembly to prevent the hammer from moving forward sufficiently to fire the firearm. In the safety position, the bolt blocks the hammer from engaging the firing pin or discharging the firearm. When the bolt is moved to the fire position, the hammer is free to move forward to strike the firing pin and discharge the firearm.

A second type of safety is a trigger block which may also be positioned to engage the trigger or a portion or extension of the trigger to prevent the trigger from being pulled or limit the displacement of the trigger when the bolt is in the safety position. In the safety position, the trigger cannot be activated to discharge the firearm. In the fire position, the trigger can be pulled to discharge the firearm.

The use of locks and locking mechanisms, including electronic devices, to further secure a firearm is also commonplace, and a wide variety of devices and techniques have been advanced. The vast majority of conventional firearm locks and locking mechanisms operate independently of the firearm safety.

SUMMARY OF THE INVENTION

Briefly stated, the invention in a preferred form is a lockable firearm safety which incorporates a locking mechanism into a cross bolt employed in a safety mechanism. The bolt is mounted in a bore disposed generally transversely of the barrel. The bolt is axially displaceable between the safety and the fire position. The bolt defines a lock recess and has a keyway axially extending through an end of the bolt. The bolt has axially spaced first and second surfaces which are respectively configured to prevent the discharge of the firearm in the safety position while allowing the firearm to discharge in the fire position. A detent assembly, which comprises a detent projectable into the lock recess of the bolt, locks the bolt in the safety position to prevent the bolt from being displaced to the fire position.

The bolt is rotatable by means of a key to an angular position which is generally diametrically opposite that of the normal safety position. The key has a blade insertable into the slot to cam the detent out of the lock recess to thereby allow the bolt to be angularly rotated and to permit axial displacement of the bolt from the safety to the fire position. The bolt also may be configured with first and second axially spaced recesses to retain the bolt in a semi-stable relationship in the safety and fire positions.

In one disclosed embodiment, the bolt is engageable with the trigger in the safety position to block the trigger from discharging the firearm. In a second disclosed embodiment, a hammer assembly is operatively connected to the trigger assembly. The bolt is engageable with the hammer assembly to block the hammer from discharging the firearm when the bolt is in the safety position. The detent assembly preferably comprises a detent pin and a spring which biases the pin toward the bolt. An outer surface of the bolt may be fixed with an indicator to indicate when the bolt is positioned in the locked angular position.

In another disclosed embodiment, the safety mechanism is secured in a locked position by means of a lock cylinder. A tailpiece extends from the lock cylinder plug. A lug extends from the tailpiece and is retainable in a slot upon angular rotation of the plug. The tailpiece includes a slot which receives an extension of the trigger when the safety is in the fire position and is also configured to engage the extension and obstruct rearward movement of the trigger when the safety is in the safety position. The lock cylinder may take the form of a key-retaining cylinder so that the key can only be removed when the locked safety position is achieved.

An object of the invention is to provide a new and improved lockable safety for a firearm.

Another object of the invention is to provide a new and improved lockable firearm safety which is reliable and provides a high degree of security for a firearm.

A further object of the invention is to provide a new and improved lockable firearm safety having an efficient and low cost construction and which can be readily incorporated into a firearm without substantial modification thereof.

A yet further object of the invention is to provide a new and improved locking device firearm which is operatively coupled in a user friendly application in conjunction with a proven safety for a firearm.

Other objects and advantages of the invention will become apparent from the specification and the drawings.

DETAILED DESCRIPTION OF THE PREFERRED EMBODIMENT

Figure 11:
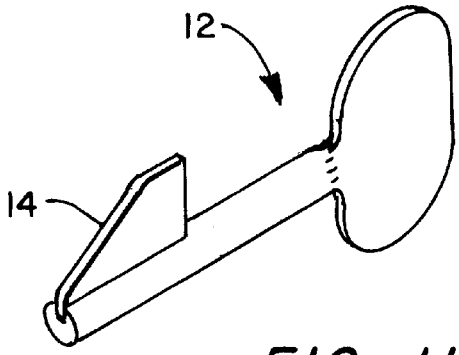
FIG. 11 is a perspective view of a representative key employed for the lockable firearm safety of FIG. 1.
Figure 12:
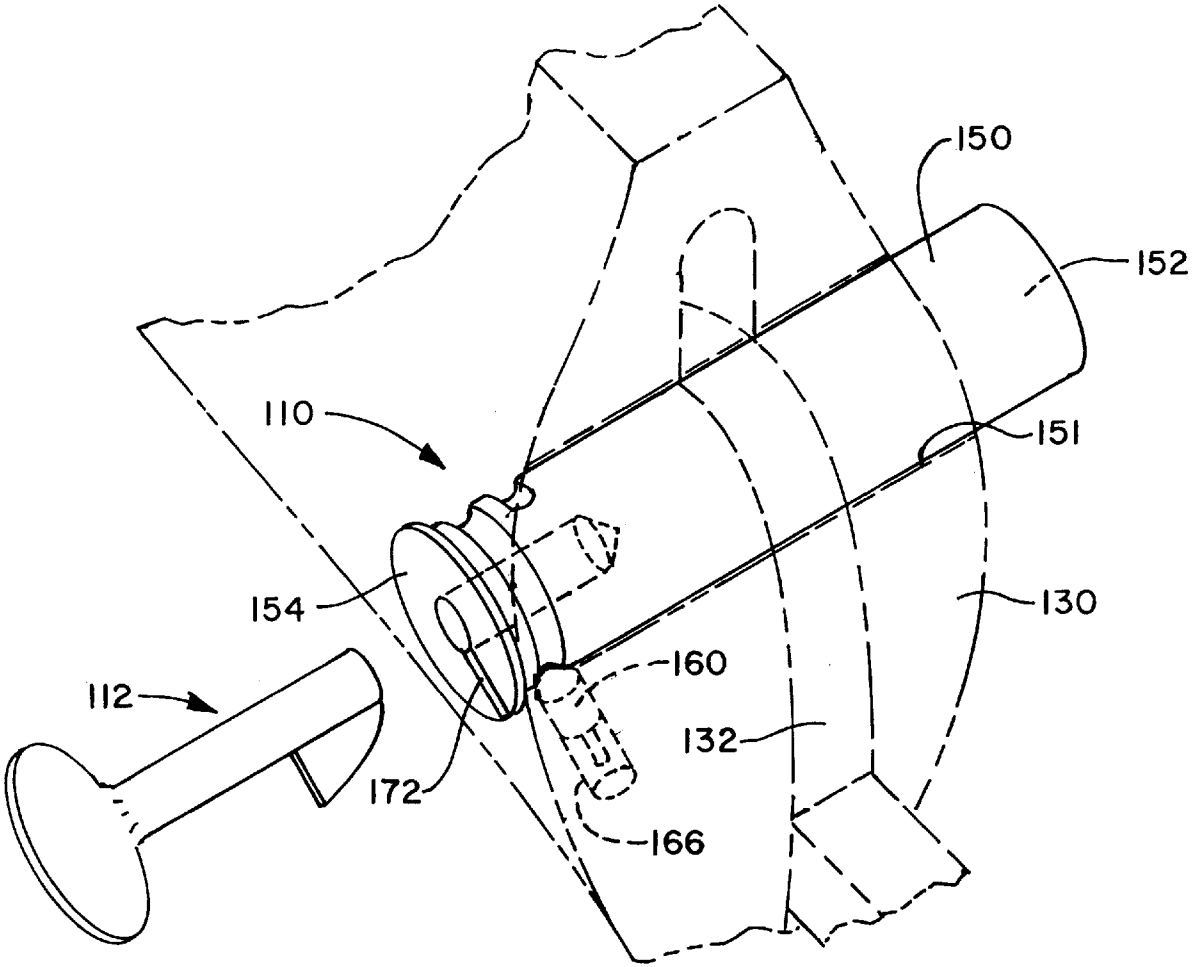
FIG. 12 is a fragmentary perspective view, partly in phantom and partly broken away, of a firearm incorporating a second embodiment of a lockable firearm safety and a corresponding key in accordance with the invention.
Figure 14:
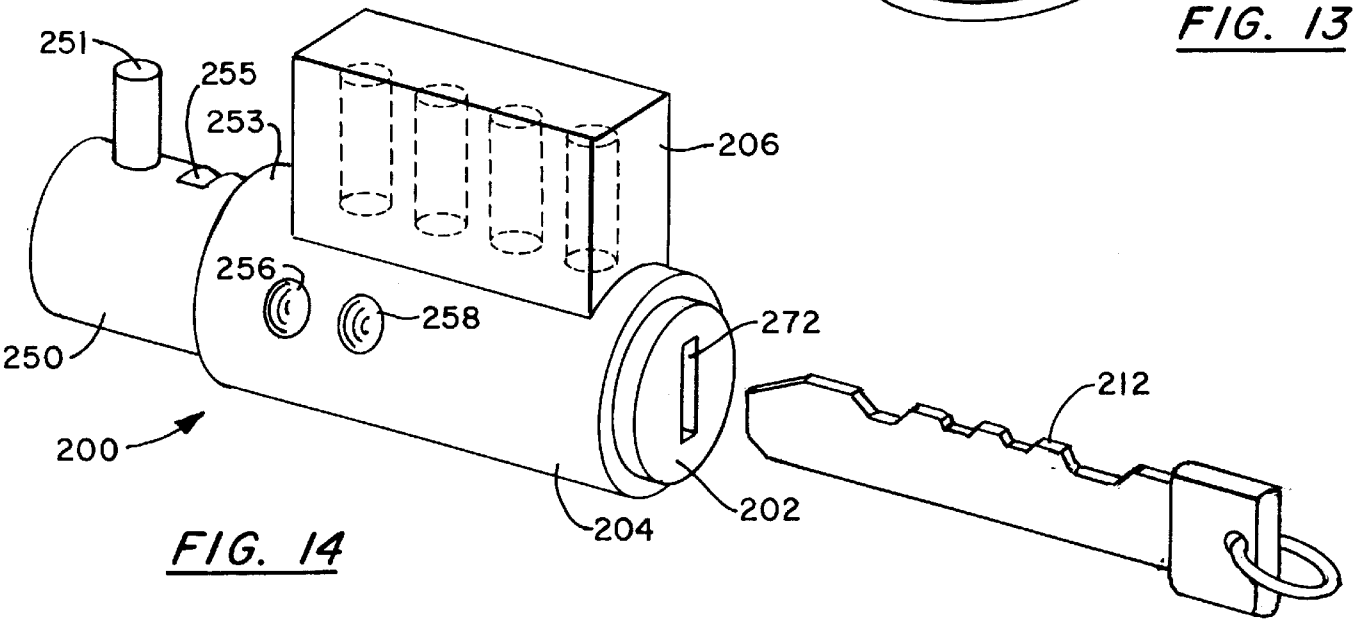
FIG. 14 is a perspective view of a lock unit and key employed in the trigger guard assembly of FIG. 13.
Figure 15:
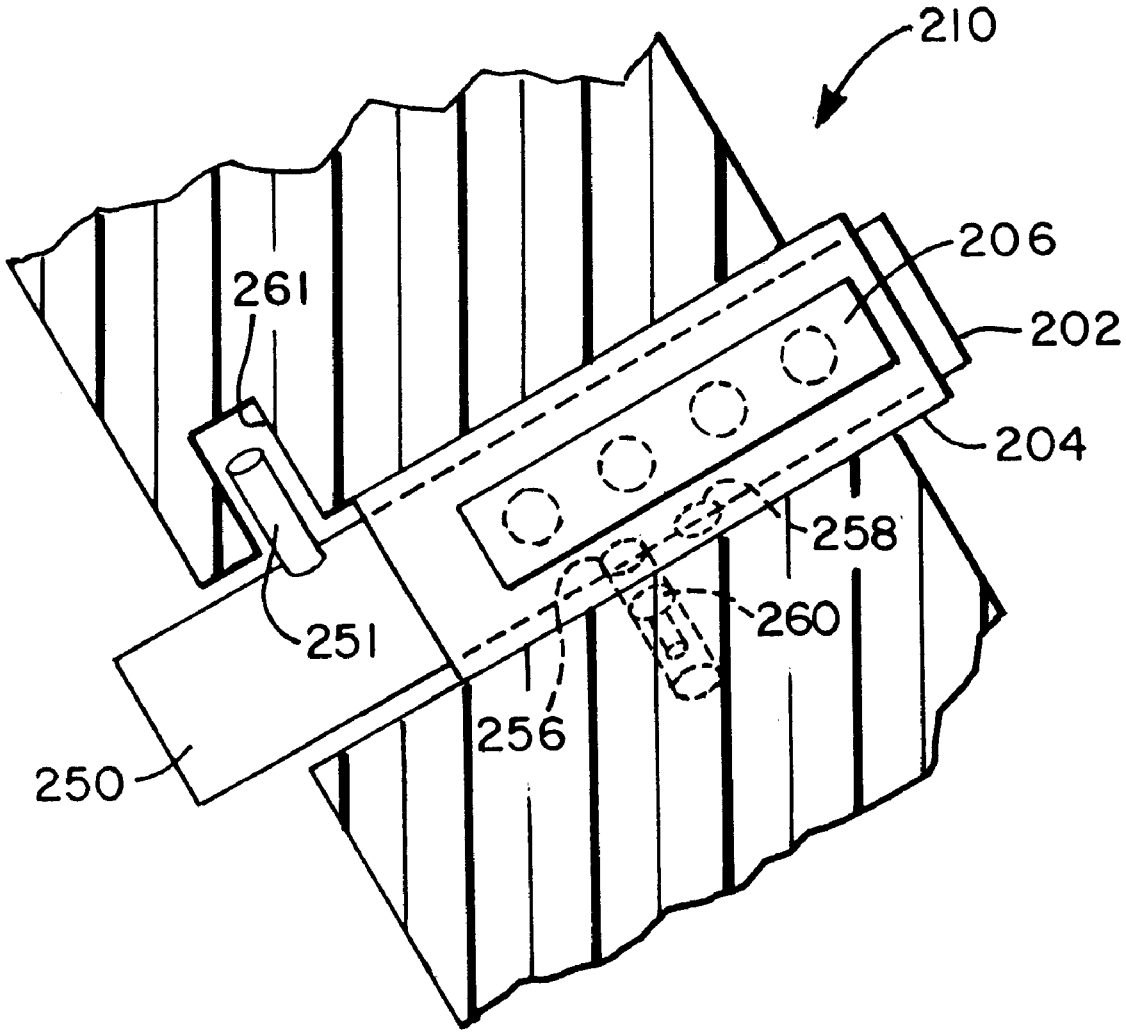
FIG. 15 is a sectional view taken along the line 15—15 of FIG. 13 with the lock unit of FIG. 14 being assembled in place, said lockable firearm assembly being partly broken away and partly illustrated in phantom.

With reference to the drawings, wherein like numerals represent like parts throughout the several figures, a lockable firearm safety in accordance with the present invention is generally designated by the numerals 10 (FIGS. 1–2), 110 (FIG. 12) and 210 (FIG. 15). The lockable firearm safety employs a key 12, 112 (FIGS. 11, 12), 212 (FIG. 14) for transforming the firearm between an unlocked and a locked safety position, as will be detailed below. The safety may assume a wide variety of forms and is configured, as will be described below, to be readily incorporated into conventional firearms to provide a trigger block-type safety 10 or a hammer block-type safety 110 which can be locked to prevent the safety from being displaced to the fire position. The safety may also employ a conventional lock mechanism such as the embodiment of safety 210.

A number of firearms employ a safety in the form of a displaceable bolt which functions to mechanically block or obstruct the discharge of the firearm when the trigger is pulled. The bolt is mounted in a transverse orientation relative to the barrel 16 of the firearm. For a hammer block-type safety, the bolt is configured to, upon selective positioning, block the hammer from striking the firing pin and in a second position allow the hammer to strike the firing pin without any interference. The bolt is typically manually displaced from the fire position to the safety position. In the safety position, the bolt blocks the hammer from striking the firing pin. For a trigger block-type safety, the bolt interacts with the trigger to limit rearward pivot of the trigger when the bolt is in the safety position, and the trigger is free to be pulled or to discharge the firearm when the bolt is in the fire position.

Figure 1:
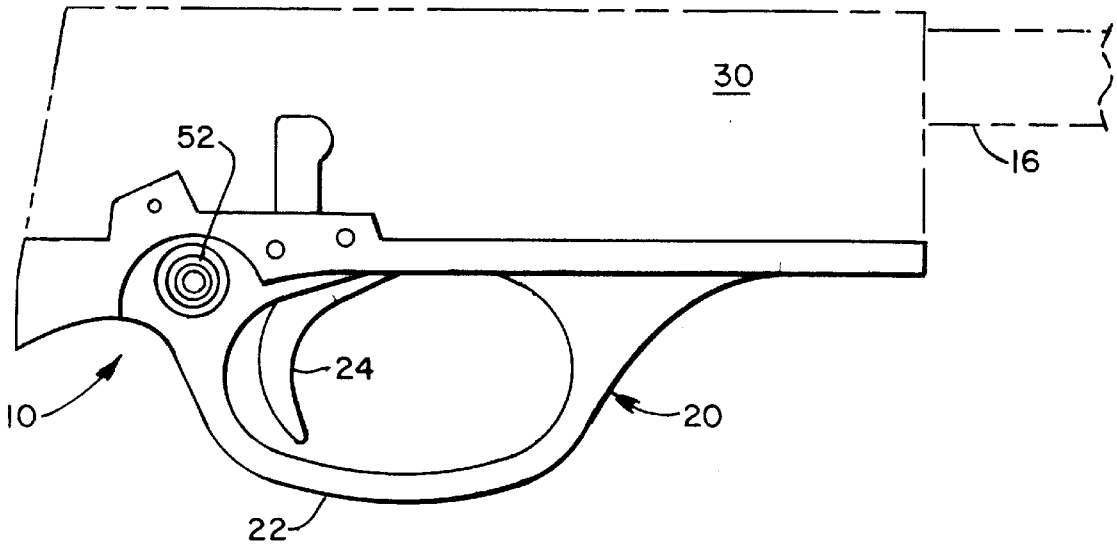
FIG. 1 is a side view of a partial firearm with the receiver and barrel in phantom showing trigger guard assembly incorporating a lockable firearm safety in accordance with the present invention.
Figure 2:
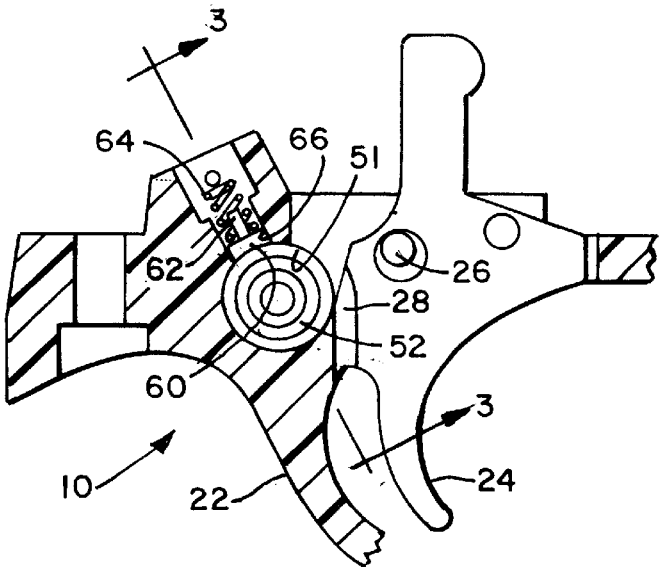
FIG. 2 is an enlarged fragmentary sectional view of the trigger guard assembly of FIG. 1.
Figure 3:
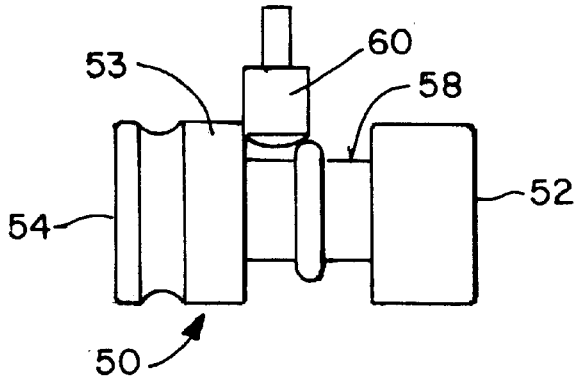
FIG. 3 is a fragmentary view of components of the lockable firearm safety of FIG. 2 viewed generally in a direction of the lines 3—3 thereof.
Figure 4:
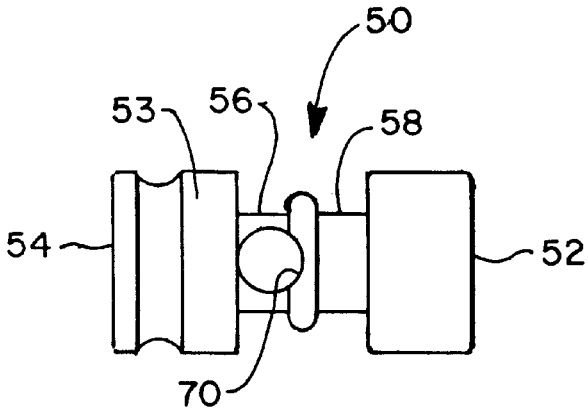
FIG. 4 is a bottom plan view of the firearm safety components of FIG. 3.
Figure 6:
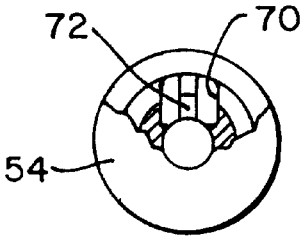
FIG. 6 is a fragmentary end sectional view, partly broken away, of the component of FIG. 5.
Figure 5:
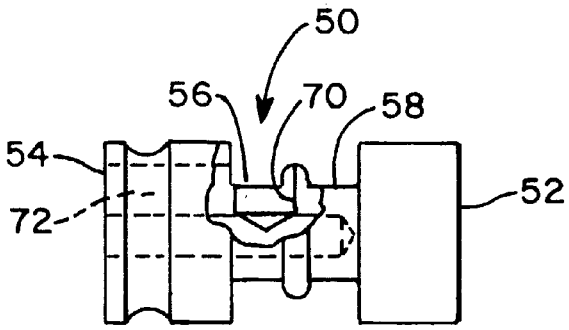
FIG. 5 is a side elevational view of the component of FIG. 4, partly broken away to show section and partly in phantom, and rotated 90° clockwise from the right portion thereof.

A representative trigger block safety which is illustrated and represents the respective conventional trigger block and safety and, for the illustrated views, the lockable firearm safety 10 in accordance with the present invention is illustrated in FIGS. 1–3. A trigger guard assembly 20 includes a trigger guard 22 for a trigger 24. The trigger guard assembly is typically mounted to the underside of the receiver 30 (not illustrated) in a conventional fashion with the trigger 24 being pivotally mounted by means of a pin 26. The trigger 24 is pulled in a conventional fashion to cause the hammer (not illustrated) to move forward and strike the firing pin (not illustrated).

The safety bolt 50 is received in a cross-bore 51 of the trigger guard or in some embodiments a cross-bore of the receiver. With reference to FIGS. 3–7, the safety bolt 50 includes opposed ends 52 and 54 typically designated as respective safe and fire ends. End 52 typically is ribbed to facilitate depressing the bolt transversely. The safe end projects transversely from the guard or receiver to indicate that the bolt is in the safe position. When the bolt is depressed inwardly, the bolt moves to a fire position. The transverse positions of the safety bolt are defined by respective axially spaced, safe and fire groove-like recesses 56 and 58.

A pin or detent 60 controlled by a plunger 62 and spring 64 is mounted in a bore 66 of the trigger guard of the receiver. Plunger bore 66 intersects cross-bore 51 in perpendicular relationship. The detent is spring-biased for projection into a recess 56, 58 to define a generally semi-stable bolt position. However, upon manual depression of the bolt 50 between the safe and the fire positions, the detent 60 is sufficiently resiliently biased and the recess defining walls of the recesses are contoured to permit the detent to cam over the rib-like boundary between one recess to the opposing recess to thereby provide a well-defined semi-stable safe and fire position for the safety bolt 50.

The safety bolt 50 is configured as required for cooperation with the various elements of the trigger/hammer assembly to either allow the hammer to move forward to a position for firing the firearm or to block such movement. For example, the trigger may have a rearward integral shoulder or tab 28 which engages a shoulder surface 53 of the bolt in the safety position and thereby prevents the trigger from moving to discharge the firearm. In the fire position, the tab 28 is free to pivot into the recess 56 without restriction. The techniques and structures for accomplishing this bistable function are quite extensive and are not the specific subject of the invention.

The safety bolt 50 is also provided with a well-like lock recess 70 (FIGS. 4–6) which has a deeper radial depth than that of the fire and safety recesses 56, 58. The recess 70 may be somewhat exaggerated in the FIG. 4 drawing. In addition, a transverse key slot 72 extends through the fire end of the bolt. The slot 72 is configured to accept the key blade 14 of key 12. When the bolt 50 is in the safe position, a key 12 may be inserted into the slot 72. The bolt is then rotated approximately 180° so that the detent 60 engages in the well under the bias of spring 64. The sides of the well are sufficiently steep so that the detent is not easily dislodged from the well, upon either torquing the bolt or applying an axial force to the bolt 50. Consequently, the bolt cannot be manually transformed to the fire position. Thus, the blocking bolt is locked in the safety position.

Figure 7A:
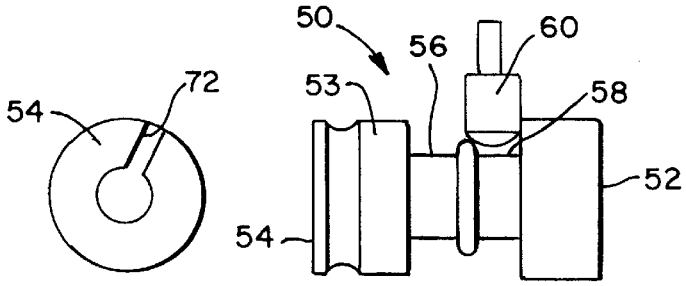
FIG. 7A is a left end view and a corresponding schematic view of the firearm components of FIG. 3 illustrating a fire position thereof.
Figure 7B:
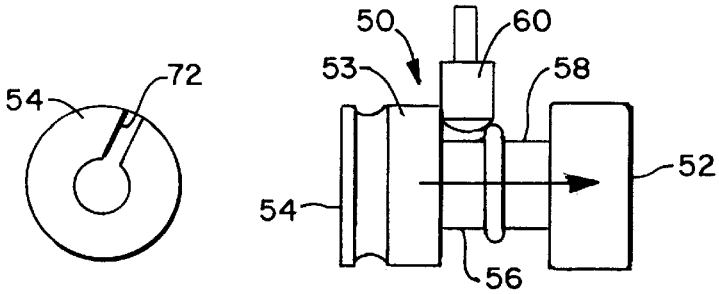
FIG. 7B is a left end view and a corresponding schematic view of the firearm safety components of FIG. 3 illustrating a safety position thereof in the unlocked position.
Figure 7C:
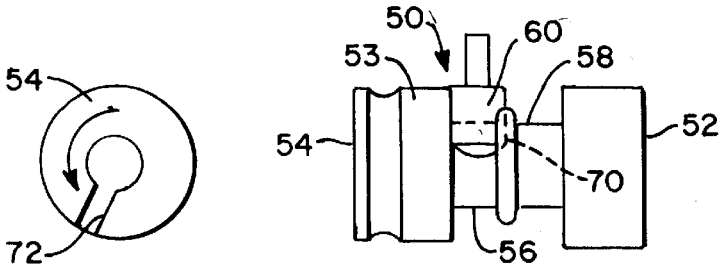
FIG. 7C is a left end view and a corresponding schematic view of the firearm safety components of FIG. 3 illustrating a safety position thereof in the locked position.
Figure 7D:
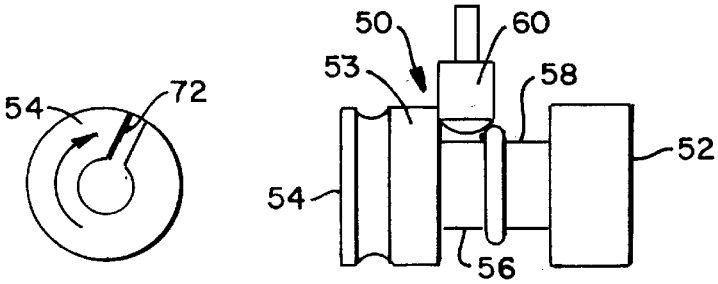
FIG. 7D is a left end view and a corresponding schematic view of the firearm safety components of FIG. 3 illustrating a safety position thereof in the unlocked position.
Figure 7E:
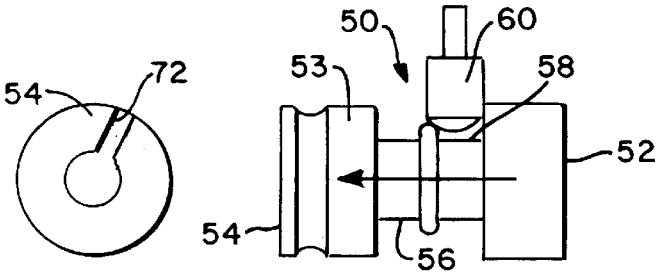
FIG. 7E is a left end view and a corresponding schematic view of the firearm components of FIG. 3 illustrating a fire position thereof.
Figure 9:
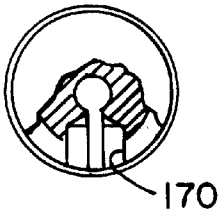
FIG. 9 is a left end view, partly broken away to show section, of the component of FIG. 8.
Figure 8:
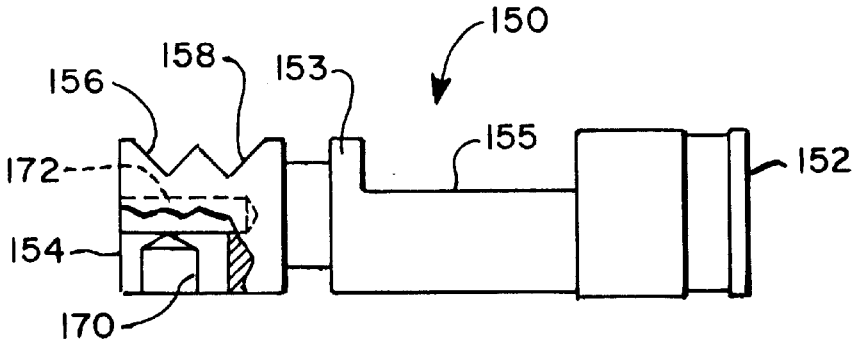
FIG. 8 is a side view, partly broken away and partly in section, illustrating an alternate embodiment of a component for firearm safety in accordance with the invention.
Figure 10:
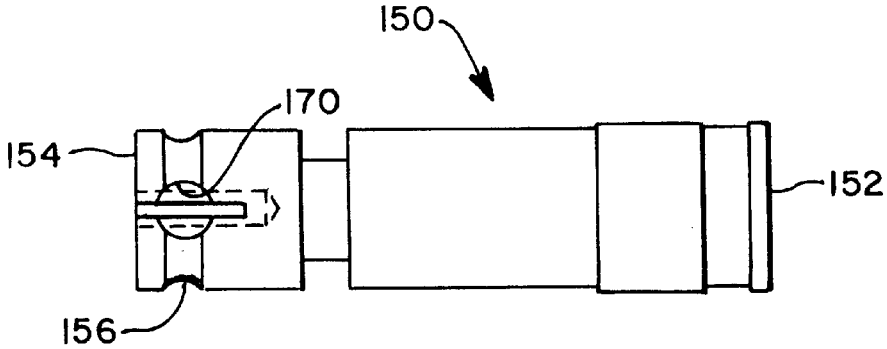
FIG. 10 is a bottom plan view of the component of FIG. 8.

The operation of the lockable firearm safety is illustrated in FIGS. 7A–7E which show the relative positions of the detent 60, safe recess 56, fire recess 58, lock recess 70 and key slot 72. FIG. 7A illustrates the safety bolt in the fire position. FIG. 7B illustrates the safety bolt in the safe position with the safety bolt being unlocked and the arrow representing the direction of axial displacement. FIG. 7C illustrates the safety bolt in the safe locked position with the arrow representing the direction of rotation from FIG. 7B to FIG. 7C. FIG. 7D illustrates the safety bolt upon return to the safety and unlocked position with the arrow illustrating the direction of rotation from FIG. 7C to FIG. 7D. FIG. 7E illustrates the position of the safety bolt in the fire position with the arrow representing the direction of axial displacement to the fire position. The safety bolt is configured so that it cannot be locked in the fire position and can only be locked and unlocked in the safety position. It should also be appreciated that the axial position of the detent 60 relative to the receiver/trigger guard is fixed, while the axial position of the safety bolt is displaceable to achieve the desired safety and fire status for the firearm.

The blade 14 of the key is configured so that the key may be inserted into slot 72 so that the blade cams the detent 60 from the well 70. This permits rotation of the bolt back to the initial safety position (FIG. 7D). The detent may follow the groove path of recess 56 to the groove position illustrated in FIG. 7D. This is the normal safety position of the bolt. The bolt is now readily transformable to the fire position by manual depression of the bolt (FIG. 7E). The detent/groove relationship is such that the detent can be cammed out of the safety recess 56 for reception into the fire recess 58.

It should be appreciated that for additional security, the detent may be replaced by a stack of tumbler pins and the key blade configured so that a sheer line is formed to permit the rotation from the locked to the unlocked position. Likewise, two or more axially spaced stacks of pins (not illustrated) may be employed.

With reference to FIGS. 8–10 and 12, lockable hammer block-type safety bolt 150 is illustrated. In this configuration, the bore 151 for the safety bolt extends through the receiver 130, and the detent bore 166 is implemented at one side at the rear of the receiver. The structures of bolt 150 corresponding to those of bolt 50 are designated by the same two digit numeral preceded by a "1." For bolt 150, the safe recess 156 only extends approximately 180° about the periphery to define a rotational path for locking and unlocking the safety bolt. The bolt 150 has a recess 155 which permits the hammer 132 to move forward and strike the firing pin (not illustrated) when the bolt is in the fire position. In the safe position, an appendage on the hammer strikes the shoulder 153 and is thereby obstructed from striking the firing pin.

Figure 13:
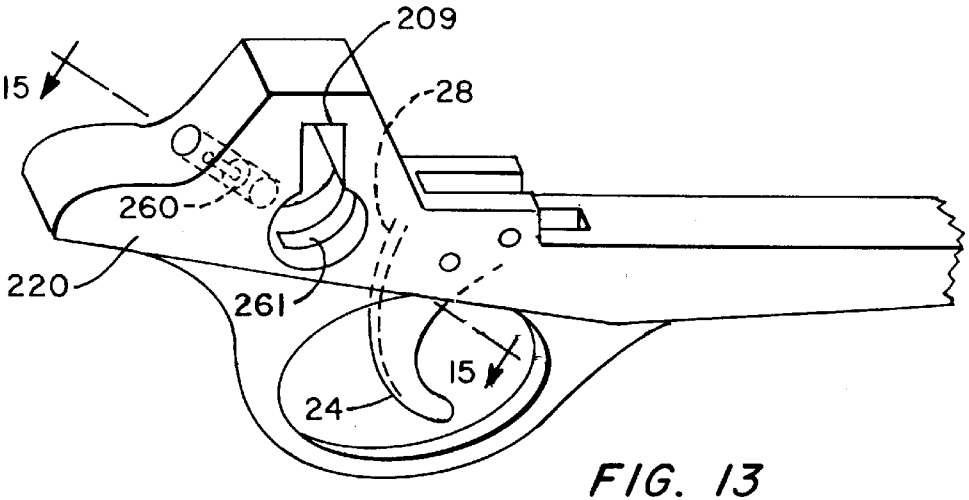
FIG. 13 is a fragmentary perspective view of trigger guard assembly which has been partially disassembled, portions being illustrated in phantom, said trigger guard assembly being employed for a third embodiment of a lockable firearm safety in accordance with the present invention.

With reference to FIGS. 13–15, a lockable firearm safety 210 employs a lock cylinder 200. The cylinder comprises a plug 202, a shell 204 and a bible 206 which houses stacks of pins. A keyway 272 receives a key 212 which is cut to engage the lock pins in a fashion which permits a shear line between the plug and shell to thereby permit rotation of the plug 202 relative to the shell 204. For comfort and convenience, rather than the usual extension, key 212 preferably has a rounded end with a rotating ring attached for rotating the key blade. The cylinder and key may be custom bitted for each firearm. The lock cylinder is preferably a key-retaining lock which prevents removal of the key unless the cylinder is in the locked rotational position. A tailpiece 250 which functions as a safety bolt projects from the rear of the lock cylinder. A locking lug 251 projects radially from the tailpiece and with respect to the rotational axis of the plug. The tailpiece also forms a channel or recess 255 (FIG. 14) which receives the trigger tab or shoulder 28 when the lock cylinder is transversely displaced to the fire position. In the safe position, the tailpiece has a surface 253 which interferes with the trigger shoulder to obstruct rearward movement of the trigger and prevent firing of the firearm. It should be appreciated that the tailpiece (not illustrated) and/or shell could be configured and positioned to form a hammer block safety. A cap (not illustrated) may be mounted to the end of the tailpiece to provide a pleasing finished appearance.

With additional reference to FIG. 13, the trigger guard frame 220 has a keyhole-shaped transverse slot 209 which receives the lock cylinder 200. The detent assembly comprises a spring-biased plunger 260 which maintains the lock cylinder in safe and fire positions by engaging axially spaced cavities 256, 258 formed in the side of the lock cylinder shell. The trigger guard frame 220 includes a slot 261 which receives the locking lug 251 upon rotation of the plug and tailpiece at a given axial position of the lock cylinder 200 constituting the safe position of the firearm.

When the firearm is in the safe locked position wherein the lock cylinder is locked, the lug 251 is retained in the slot 261, and axial displacement of the safety which comprises the lock cylinder, including the tailpiece, is axially limited. The safety can be axially displaced to the fire position by rotating (unlocking) the lock cylinder with the key and transversely axially moving the cylinder to the fire position. In the fire position, the shoulder 28 on the trigger will pivot into the slot on the tailpiece and allow the firearm to fire. It is preferred that the lock cylinder be a key-retaining lock wherein the key will be retained in the cylinder when the firearm is in the fire position and may only be removed from the lock when the locked safety position is obtained. The key will thus always be required to fire the firearm.

It will be appreciated that other forms of the lockable safety may be employed to provide for a secure lock position in the safety mode and allow the firearm to be unlocked and the firearm used in a conventional manner in conjunction with the block-type safety.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A safety assembly for a firearm having a barrel comprising:

a trigger activatable for discharging said firearm;

bore means for defining a bore disposed generally transversely relative to said barrel;

a bolt mounted in said bore and axially displaceable therein between a safety position and a fire position, said bolt having axially spaced first and second surfaces respectively configured to prevent said trigger from discharging said firearm in said safety position and allowing said trigger to discharge said firearm in said fire position, said bolt defining a lock recess and a keyway axially extending through an end of said bolt; and a pin assembly comprising a pin projectable into said lock recess of said bolt, so that when said bolt is positioned in said safety position said bolt is rotatable to an angular position wherein said pin projects into said lock recess to prevent said safety bolt from being displaced to said fire position.

2. The safety assembly of claim 1 further comprising a key having a blade, said blade being insertable into said keyway to displace said pin out of said lock recess to thereby allow said bolt to be angularly rotated to permit axial displacement of said bolt from said safety to said fire position.

3. The safety assembly of claim 1 wherein said bolt further comprises first and second axial spaced recesses diametrically opposite said lock recess.

4. The safety assembly of claim 3 wherein said pin is projectable into said first and second recesses to retain said bolt in semi-stable relationship in said safety and said fire position.

5. The safety assembly of claim 1 wherein said bolt is engageable with said trigger in said safety position to block said trigger from discharging said firearm.

6. The safety assembly of claim 1 further comprising a hammer assembly operatively connected to said trigger assembly and wherein said bolt is engageable with said hammer assembly to block said hammer from discharging said firearm in said safety position.

7. The safety assembly of claim 1 further comprising an indicator to indicate that the bolt is positioned in said angular position wherein said pin projects into said lock recess.

8. A safety assembly for a firearm having a barrel comprising:

a trigger activatable for discharging said firearm;

bore means for defining a bore disposed generally transversely relative to said barrel;

a bolt mounted in said bore and axially displaceable therein between a safety position and a fire position, said bolt having a first recess and a second recess corresponding to said safety and said fire positions, said bolt having axially spaced first and second surfaces to prevent said trigger from discharging said firearm in said safety position and allowing said trigger to discharge said firearm in said fire position, said bolt defining a lock recess and a keyway axially extending through an end of said bolt; and a pin assembly comprising a pin projectable into said lock recess of said bolt, so that when said bolt is positioned in said safety position said bolt is rotatable to an angular position wherein said pin projects into said lock recess to prevent said safety bolt from being displaced to said fire position.

9. The safety assembly of claim 8 wherein said lock recess is diametrically opposite said safety recess in general axial alignment therewith.

10. The safety assembly of claim 8 wherein said first and second recesses are in general angular alignment.

11. The safety assembly of claim 8 wherein said pin assembly comprises a spring which biases said pin toward said bolt.

12. The safety assembly of claim 8 further comprising a key which is insertable into said keyway, said key having a blade portion which upon insertion forces said pin from said locking recess to permit angular rotation to an unlocked angular safety position.

* * * * *